US010220261B1

(12) United States Patent
Garsdean

(10) Patent No.: US 10,220,261 B1
(45) Date of Patent: Mar. 5, 2019

(54) MOUNTABLE RESISTANCE EXERCISE DEVICE

(71) Applicant: Julian Garsdean, Burbank, CA (US)

(72) Inventor: Julian Garsdean, Burbank, CA (US)

( * ) Notice: Subject to any disclaimer, the term of this patent is extended or adjusted under 35 U.S.C. 154(b) by 0 days.

(21) Appl. No.: 15/786,537

(22) Filed: Oct. 17, 2017

(51) Int. Cl.
*A63B 21/00* (2006.01)
*A63B 23/12* (2006.01)
(Continued)

(52) U.S. Cl.
CPC .... *A63B 24/0087* (2013.01); *A63B 21/00058* (2013.01); *A63B 21/018* (2013.01);
(Continued)

(58) Field of Classification Search
CPC ..... A63B 21/00058; A63B 21/00069; A63B 21/00076; A63B 21/00178; A63B 21/00181; A63B 21/00185; A63B 21/002; A63B 21/0023; A63B 21/005; A63B 21/0058; A63B 21/0059; A63B 21/012; A63B 21/0125; A63B 21/015; A63B 21/018; A63B 21/02; A63B 21/021; A63B 21/022; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/065; A63B 21/068; A63B 21/08; A63B 21/15; A63B 21/151; A63B 21/152; A63B 21/153; A63B 21/154; A63B 21/22; A63B 21/225; A63B 21/227; A63B 21/4017; A63B 21/4019; A63B 21/4021; A63B 21/4025; A63B 21/4027; A63B 21/4033; A63B 21/4035; A63B 21/4045; A63B 21/4047; A63B 21/4049; A63B 22/0076; A63B 2022/0079; A63B 23/035; A63B 23/03508; A63B 23/03516; A63B 23/03533; A63B 23/03541; A63B 23/12;
(Continued)

(56) References Cited

U.S. PATENT DOCUMENTS 3,191,880 A * 6/1965 Visconti ..... A63B 69/0079 242/386
3,640,530 A * 2/1972 Henson ..... A63B 21/015 482/116

(Continued)

*Primary Examiner* — Gary D Urbiel Goldner
(74) *Attorney, Agent, or Firm* — Thomas I. Rozsa

(57) ABSTRACT

An exercise device for attachment to an exercise machine includes an enclosure having an outer wall that defines an internal space therein, at least one cable aperture and an attachment mechanism for attaching to the exercise machine. A winding assembly is rotationally captured within the internal space and includes a winding spool configured for receiving at least one cable wound therearound under the urging of a coil spring. A motor is used to compress or retract a torsion spring fixed between a moving rotor plate and the winding spool for changing a cable unwind resistance. A controller circuit is electrically connected with at least a power source, a user interface, and the motor. To perform exercises with the exercise device, a person sets a desired cable unwind resistance with the user interface and then repeatedly pulls and releases the cable.

4 Claims, 5 Drawing Sheets

(51) Int. Cl.
*A63B 24/00* (2006.01)
*A63B 21/018* (2006.01)
*A63B 23/035* (2006.01)

(52) U.S. Cl.
CPC ..... *A63B 23/03516* (2013.01); *A63B 23/12* (2013.01); *A61H 2201/0107* (2013.01); *A63B 2210/58* (2013.01)

(58) Field of Classification Search
CPC ..... A63B 23/1209; A63B 23/1245; A63B 23/1281; A63B 24/0062; A63B 24/0075; A63B 24/0087; A63B 2024/0065; A63B 2024/0068; A63B 2024/0071; A63B 2024/0078; A63B 2024/0081; A63B 2024/009; A63B 2024/0093; A63B 2024/0096; A63B 69/06; A63B 2069/062; A63B 71/0054; A63B 71/0619; A63B 71/0622; A63B 71/0686; A63B 2071/0063; A63B 2071/0072; A63B 2071/0081; A63B 2071/009; A63B 2071/065; A63B 2071/0658; A63B 2071/0661; A63B 2071/0675; A63B 2071/0683; A63B 2071/0694; A63B 2209/00; A63B 2209/08; A63B 2210/00; A63B 2210/50; A63B 2210/58; A63B 2220/10; A63B 2220/16; A63B 2220/17; A63B 2220/20; A63B 2220/24; A63B 2220/30; A63B 2220/34; A63B 2220/35; A63B 2220/36; A63B 2220/40; A63B 2220/44; A63B 2220/50; A63B 2220/51; A63B 2220/54; A63B 2220/58; A63B 2220/62; A63B 2220/64; A63B 2220/80; A63B 2220/801; A63B 2220/803; A63B 2225/09; A63B 2225/093; A63B 2225/096; A63B 2225/20; A63B 2225/50; A63B 2225/52; A63B 2225/54
See application file for complete search history.

(56) References Cited

U.S. PATENT DOCUMENTS 4,678,184 A * 7/1987 Neiger ..... A63B 21/0058 482/118
4,753,442 A * 6/1988 Bland ..... A63B 69/0079 273/330
4,912,638 A * 3/1990 Pratt, Jr. ..... A61B 5/1121 128/905
4,979,733 A * 12/1990 Prud'Hon ..... A63B 21/0058 482/4
5,304,104 A * 4/1994 Chi ..... A63B 21/0058 482/1
5,409,435 A * 4/1995 Daniels ..... A63B 21/0056 482/5
5,697,869 A * 12/1997 Ehrenfried ..... A63B 21/0058 482/129
5,738,611 A * 4/1998 Ehrenfried ..... A63B 21/023 482/129
6,210,348 B1 * 4/2001 Reed ..... A61H 1/0292 482/72
6,280,361 B1 * 8/2001 Harvey ..... A63B 21/025 482/101
8,013,457 B2 * 9/2011 Bulthaup ..... H02K 7/1853 290/1 R
8,075,453 B1 * 12/2011 Wilkinson ..... A63B 22/0005 482/51
8,093,731 B2 * 1/2012 Bulthaup ..... H02K 7/1853 206/37.1
8,845,499 B1 * 9/2014 Boatwright ..... A63B 21/015 482/116
9,833,662 B2 * 12/2017 Potter ..... A63B 24/0087
9,844,692 B2 * 12/2017 Rollins ..... A63B 21/0058
2002/0025891 A1 * 2/2002 Colosky, Jr. ..... A63B 21/025 482/127
2002/0086779 A1 * 7/2002 Wilkinson ..... A63B 21/00069 482/118
2008/0157637 A1 * 7/2008 Bulthaup ..... H02K 7/1853 310/75 R
2010/0197467 A1 * 8/2010 Hector ..... A63B 69/12 482/55
2011/0287910 A1 * 11/2011 Ladd ..... A63B 21/00069 482/127
2012/0053014 A1 * 3/2012 Zhu ..... A63B 21/00069 482/5
2013/0267384 A1 * 10/2013 Eldridge ..... A63B 24/0087 482/5
2013/0310230 A1 * 11/2013 Norris ..... A63B 21/018 482/115
2014/0038777 A1 * 2/2014 Bird ..... A63B 21/0058 482/5
2014/0113779 A1 * 4/2014 Loach ..... A63B 21/0004 482/115
2014/0194250 A1 * 7/2014 Reich ..... A63B 24/0062 482/5
2014/0194251 A1 * 7/2014 Reich ..... A63B 24/0087 482/6
2014/0287876 A1 * 9/2014 Etter ..... A63B 24/0087 482/5
2014/0342878 A1 * 11/2014 Hashish ..... A63B 21/0058 482/8
2015/0306459 A1 * 10/2015 Boyette ..... A63B 24/0075 482/5
2016/0101322 A1 * 4/2016 Potter ..... A63B 24/0087 482/6
2016/0158603 A1 * 6/2016 Darwood ..... G06F 19/3481 482/5
2016/0332019 A1 * 11/2016 Rollins ..... A63B 21/0058
2017/0333756 A1 * 11/2017 Bird ..... A63B 21/0058
2018/0001128 A1 * 1/2018 Norris ..... A63B 21/4035
2018/0021616 A1 * 1/2018 Orady ..... A63B 21/0059
2018/0021617 A1 * 1/2018 Krull ..... A63B 21/00069

* cited by examiner

MOUNTABLE RESISTANCE EXERCISE DEVICE

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to exercise devices, and more particularly to an electric resistance exercise device.

DISCUSSION OF RELATED ART

Most exercise machines are designed for performing only a limited number of exercises thereon, focusing on a particular group of muscles. For example, exercise bicycles are focused on emulating a bicycle and replicating the manner in which a bicycle is used to strengthen leg muscles. Meanwhile, the arm muscles are essentially untouched when using a bicycle-type exercise machine. Many different types of exercise machines have a similar problem.

Therefore, there is a need for a device that can be mounted to an exercise machine to provide supplemental exercise of muscles not specifically targeted by the exercise machine. Such a need device would be portable and light-weigh, so that the device could be moved from machine to machine by the user if desired. Alternately, multiple machines could be utilized on different exercise machines. Such a needed exercise machine would be relatively simple to manufacture and use, and would offer enhancements for use with the person's smartphone or a remote control so that resistance experienced by the person could be easily adjusted while performing the exercises. The present invention accomplishes these objectives.

SUMMARY OF THE INVENTION

The present invention is an exercise device for attachment to an exercise machine used by a person to perform exercises. Such an exercise machine may be an exercise bicycle, for example, wherein the person performs leg exercises using the exercise bicycle and performs supplemental arm exercises with the exercise device of the present invention.

The exercise device includes a rigid enclosure having an outer wall that defines an internal space therein. The enclosure includes at least one cable aperture and an attachment mechanism configured for selective attachment to the exercise machine. The attachment mechanism preferably includes at least one magnet fixed with the enclosure and configured for magnetically attaching to a magnetically-attractive surface of the exercise machine. Alternately, or in addition, the attachment mechanism may include a mechanical clamp that is fitted into a dovetail slot.

A winding assembly of the exercise device is rotational captured within the internal space of the enclosure and includes a winding spool configured for receiving a proximal end of at least one cable wound therearound in a first rotational direction under the urging of a coil spring that has a winding spring tension. The winding spool rotates in an opposite, second direction when a distal end of the at least one cable is pulled away from the winding spool with sufficient force to overcome the winding spring tension, such as when pulled by the person while performing exercises.

A motor is preferably included that has a rotational shaft fixed with a threaded screw shaft. A rotor plate is fixed with the screw shaft such that rotation of the motor moves the rotor plate either towards or way from the winding spool. A torsion spring is fixed between the rotor plate and the winding spool such that rotating the rotor plate causes the torsion spring to increase or decrease a cable unwind resistance, inhibiting or assisting the unwinding of the at least one cable from the winding spool. Preferably the motor, threaded shaft, rotor plate, coil spring and the winding spool are all mutually coaxially aligned along a common longitudinal axis.

A controller circuit is fixed at least partially within the enclosure and is electrically connected with at least a power source, a user interface, and the motor. The power source is preferably one of a plurality of separately rechargeable battery packs such as are used with battery-operated power tools, or the like. Alternately the power source may be a power cord plugged into a wall outlet or an AC adapter, or the like. The user interface includes an input for changing the cable unwind resistance.

As such, to perform the exercises, with the enclosure fixed to the exercise machine at the attachment mechanism, the person sets the desired cable unwind resistance with the user interface and then pulls the at least one cable to unwind the at least one cable from the winding spool. The winding spring tension of the coil spring thereafter rewinds the at least one cable onto the winding spool when the person releases tension on the at least one cable. The person then pulls the at least one cable again to repeat the process.

Preferably the distal end of the at least one cable is fixed with a grip element, such as an exercise bar, to facilitate the person pulling the at least one cable. The exercise device can alternately have two of the cables each terminating at a handle.

The user interface of the controller circuit preferably includes at least a switch for increasing cable unwind resistance and a switch for decreasing cable unwind resistance. Such switches may be soft switches displayed on a touch-screen by a software application running on the controller circuit, at least one wireless remote, a smart phone, or the like. In some embodiments the controller circuit includes a wireless transceiver to communicate with the at least one wireless remote or the smart phone through the use of commonly-used wireless protocols such as BLUETOOTH®, WIFI®, or the like.

Preferably such a wireless remote is fixed proximate the distal end of the at least one cable, such that the person has ready access to the switches. For example, the at least one wireless remote may be incorporated into the handles so that while the person is exercising he may increase or decrease the cable unwind resistance without ceasing to exercise.

The present invention is an exercise device that is mounted to an exercise machine to provide supplemental exercise of muscles not specifically targeted by the exercise machine. The present device is portable and light-weight so that the device can be moved from machine to machine by the user if desired. Alternately, multiple machines can be utilized on different exercise machines. The present invention is relatively simple to manufacture and use, and provides enhancements for use with the person's smartphone or a remote control so that resistance experienced by the person is easily adjusted while performing the exercises. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
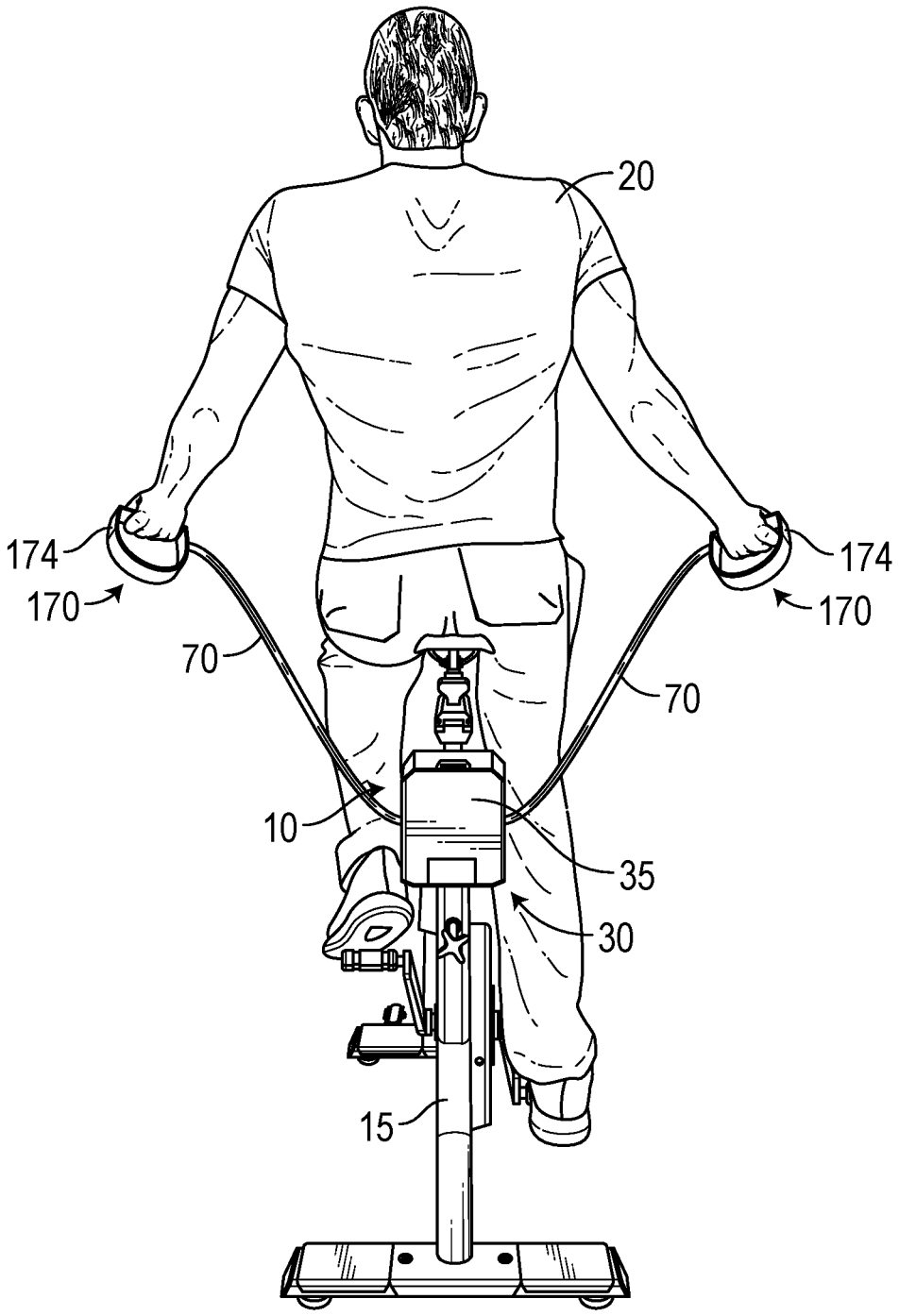
FIG. 1 is a rear elevational view of the invention, illustrated as being used by a person on an exercise bicycle.
Figure 2:
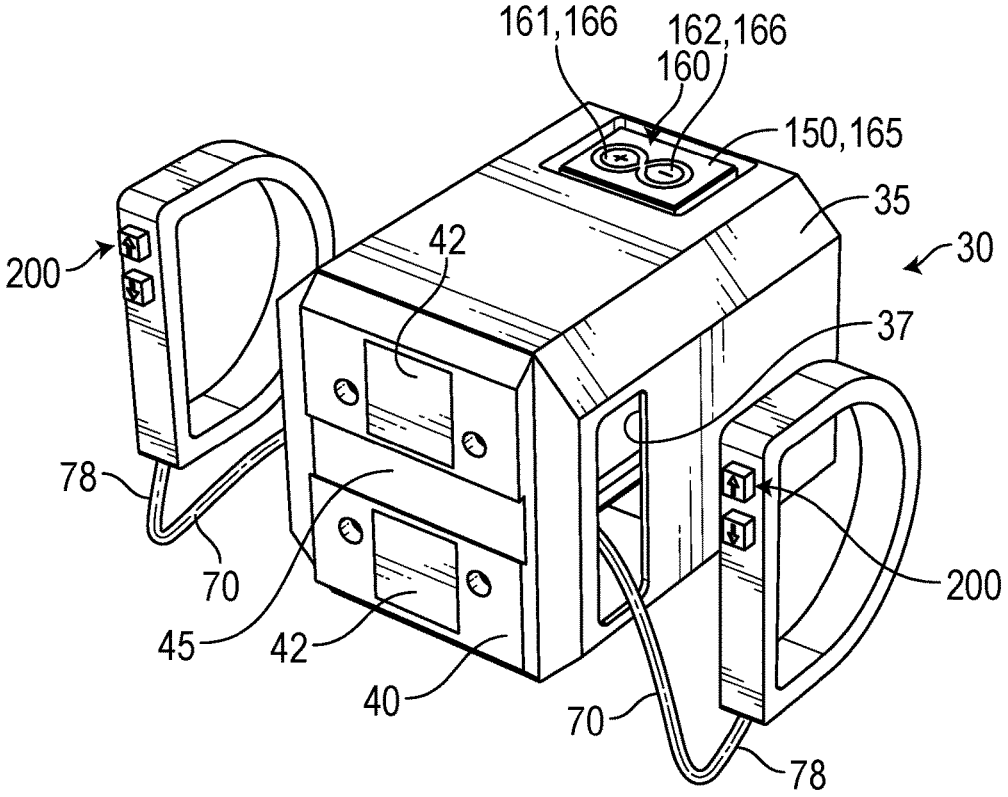
FIG. 2 is a front perspective view of the invention.
Figure 3:
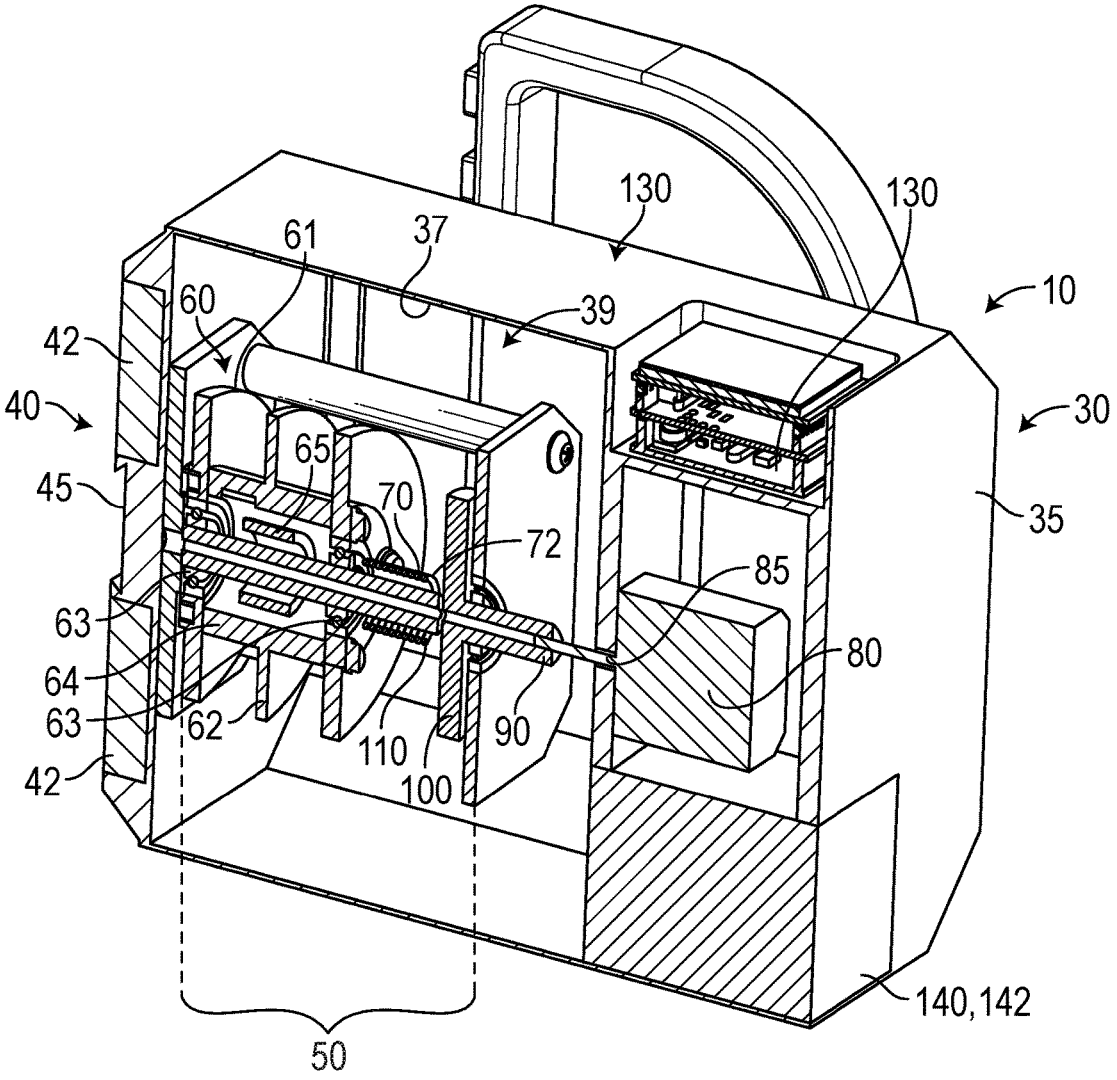
FIG. 3 is a cross-sectional view of the invention taken along a vertical plane through a rotational axis of a winding assembly and motor.
Figure 5A:
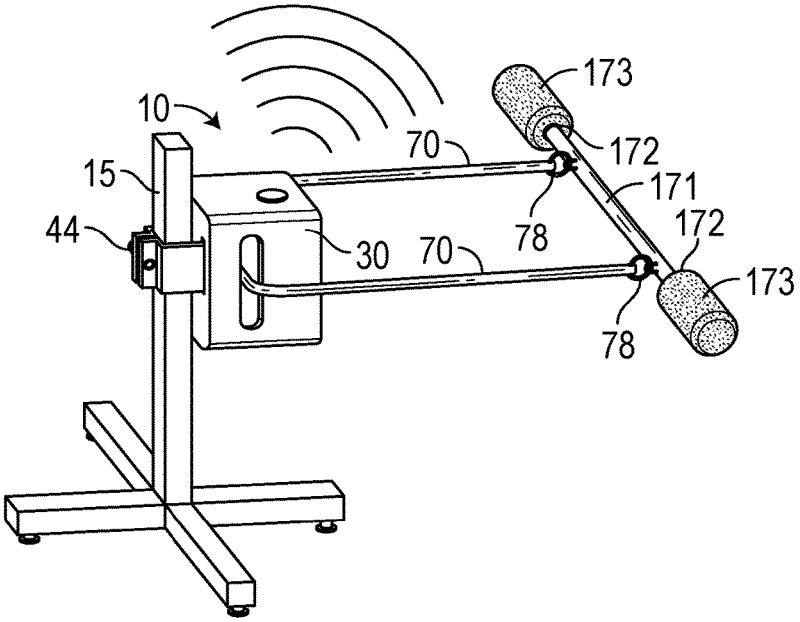
FIG. 5A is a perspective view of the invention as used on an alternate exercise machine, illustrating a wireless smartphone interface.

FIGS. 1-3 illustrate an exercise device 10 for attachment to an exercise machine 15 used by a person 20 to perform exercises. Such an exercise machine 15 may be an exercise bicycle 15 as illustrate in FIG. 1, wherein the person 20 performs leg exercises using the exercise bicycle 15 and performs supplemental arm exercises with the exercise device 10 of the present invention. Alternately, as illustrated in FIG. 5A, the exercise machine 15 may be a post for mounting of the exercise device 10 of the present invention, or any other suitable exercise machine 15 currently known or that becomes available in the future.

The exercise device 10 of the present invention includes a rigid enclosure 30 having an outer wall 35 that defines an internal space 39 therein. Such an enclosure 30 may have an openable side (not shown) for services components in the internal space 39, as is known in the art.

The enclosure 30 includes an attachment mechanism 40 configured for selective attachment to the exercise machine 15, and at least one cable aperture 37. The attachment mechanism 40 preferably includes at least one magnet 42 fixed with the enclosure 30 and configured for magnetically attaching to a magnetically-attractive surface of the exercise machine 15. Alternately, or in addition, the attachment mechanism may include a mechanical clamp 44 that is fitted into a dovetail slot 45 (FIGS. 3 and 5A).

Figure 4A:
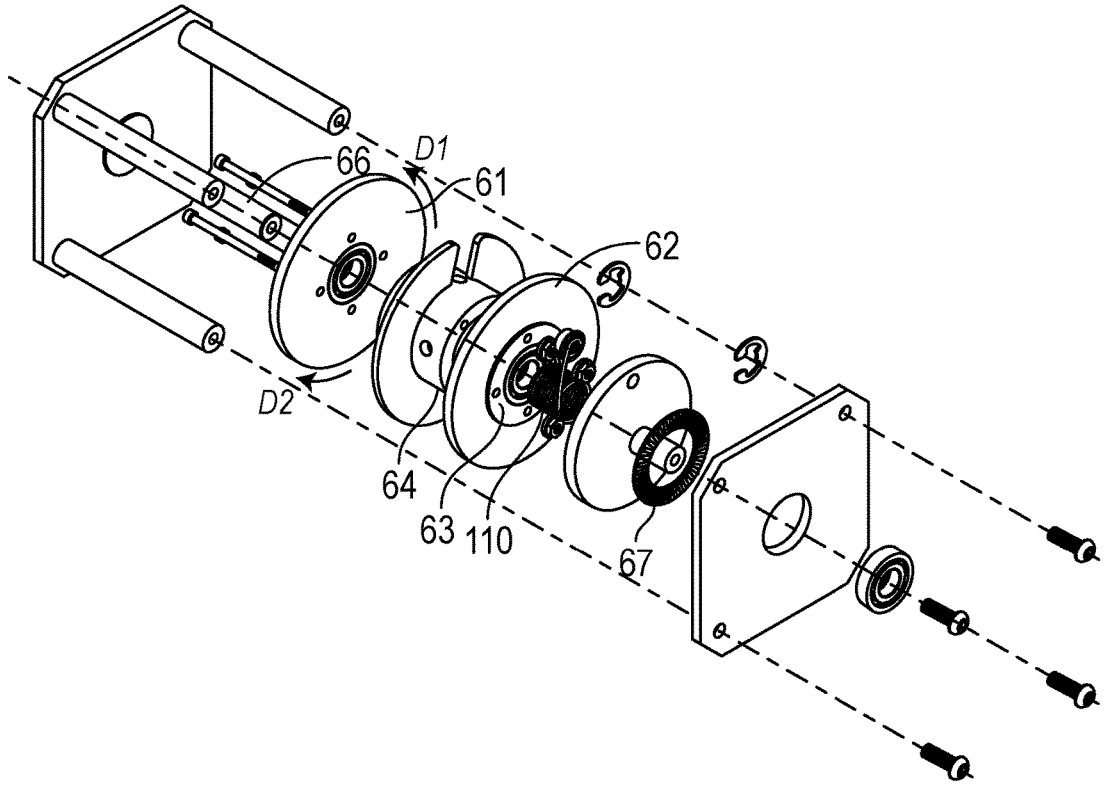
FIG. 4A is a partial perspective exploded view of the winding assembly, cables of the winding assembly omitted for clarity of illustration.
Figure 4B:
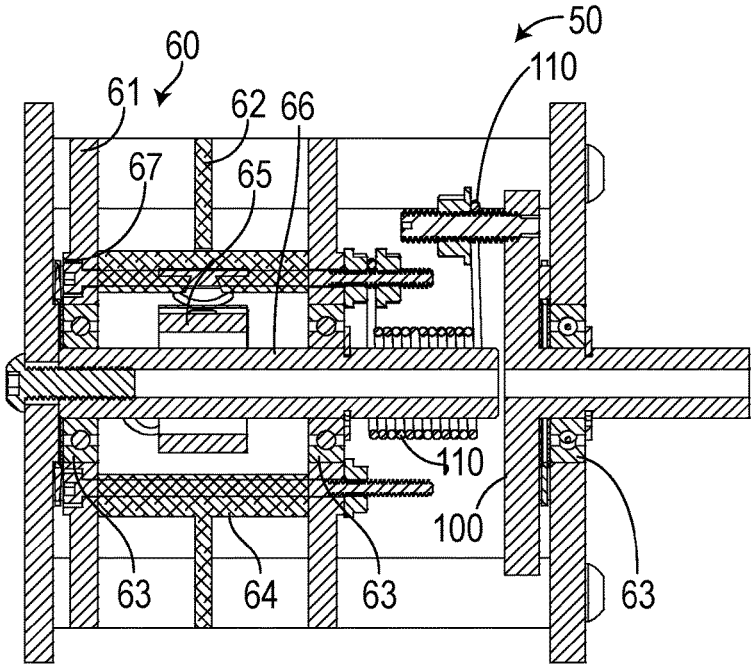
FIG. 4B is a cross-sectional view of the winding assembly of the invention taken along the vertical plane through a rotational axis of a winding assembly and motor.

A winding assembly 50 (FIGS. 4A and 4B) of the exercise device is rotational captured within the internal space 39 of the enclosure 30 and includes a winding spool 60 configured for receiving a proximal end 72 of at least one cable 70 wound therearound in a first rotational direction $D_1$ (FIG. 4A) under the urging of a coil spring 65 that has preferably a substantially constant winding spring tension. The winding spool 60 rotates in an opposite, second direction $D_2$ when a distal end 78 of the at least one cable 70 is pulled away from the winding spool 60 with sufficient force to overcome the winding spring tension, such as when pulled by the person 20 while performing exercises.

A motor 80 (FIG. 3) is preferably included that has a rotational shaft 85 fixed with a threaded screw shaft 90. A rotor plate 100 is fixed with the screw shaft 90 such that rotation of the motor 80 moves the rotor plate 100 either towards or way from the winding spool 60. A torsion spring 110 is fixed between the rotor plate 100 and the winding spool 60 such that rotating the rotor plate causes the torsion spring 110 to increase or decrease a cable unwind resistance 120, inhibiting or assisting, respectively, the unwinding of the at least one cable 70 from the winding spool 60. Alternately a manual knob (not shown) replaces the motor 80, wherein the person 20 can manually adjust the rotation of the rotor plate 100. Preferably the motor 80, threaded shaft 90, rotor plate 100, coil spring 65 and the winding spool 60 are all mutually coaxially aligned along a common longitudinal axis.

A controller circuit 130 is fixed at least partially within the enclosure 30 and is electrically connected with at least a power source 140, a user interface 150, and the motor 80. The power source 140 is preferably one of a plurality of separately rechargeable battery packs 142 such as are used with battery-operated power tools, or the like. Alternately the power source 140 may be a power cord plugged into a wall outlet or an AC adapter, or the like. The user interface 150 includes an input 160 for changing the cable unwind resistance 120 (FIGS. 2 and 5A).

As such, to perform the exercises, with the enclosure 30 fixed to the exercise machine 15 at the attachment mechanism 40, the person 20 sets the desired cable unwind resistance 120 with the user interface 150 and then pulls the at least one cable 70 to unwind the at least one cable 70 from the winding spool 60. The winding spring tension of the coil spring 65 thereafter rewinds the at least one cable 70 onto the winding spool 60 when the person releases tension on the at least one cable 70, preferably with enough tension that the at least one cable 70 does not droop when retracting, and instead retracts completely and at a brisk pace. The combination of the coil spring 65 and the torsion spring 110 accomplish this return resistance. The person 20 then pulls the at least one cable 70 again to repeat the process.

Preferably the distal end 78 of the at least one cable 70 is fixed with a grip element 170, such as an exercise bar 171 (FIG. 5A), to facilitate the person 20 pulling the at least one cable 70. Such an exercise bar 171 preferably has two opposing ends 172 each covered with a grip material 173. The at least one cable 70 is fixed with the exercise bar 171 through the use of suitable rigid connectors such as O-rings, carabiners, or the like. Alternately, as illustrated in FIGS. 1 and 2, the exercise device 10 can have two of the cables 70 each terminating at a handle 174. In some embodiments the grip element 170 may be a foot strap (not shown) for conducting foot and/or leg exercises. Likewise, the grip element 170 may be a torso strap (not shown) for conducting core muscle group exercises, such as ab exercises, or the like.

Preferably the winding spool 60 further includes a first circular flange 61 and a second circular flange 62 (FIGS. 4A & 4B), each having a rotational bearing 63 and coupled to a spool base ring 64 that is fixed with the coil spring 65. As such the coil spring 65 retracts the at least one cable 70 onto the spool 60 in the first direction $D_1$ when tension on the at least one cable 70 is released and when tension on the torsion spring 110 is released. Conversely, when the at least one cable 70 is pulled by the person 20 the spool 60 spins in the second direction $D_2$. The spool base ring 64 and the first and second circular flanges 61,62 are preferably mounted on an axle 66, the coil spring 65 being fastened between the spool base ring 64 and the axle 65.

In one embodiment, not illustrated, the spool base ring 64 is rotationally coupled to the first and second circular flanges 61,62 with a ratchet mechanism for retracting the at least one cable 70 onto the base ring 64 under tension from the coil spring 65, but without rotating the first and second circular flanges 61,62. When the at least one cable 70 is pulled by the person 20, the ratchet mechanism locks the spool base ring 64 to the first and second circular flanges 61,62, and thus the tension of the torsion spring 110 against the second circular flange 62 is transmitted to the person 20 as increased resistance for performing the exercise.

Figure 5B:
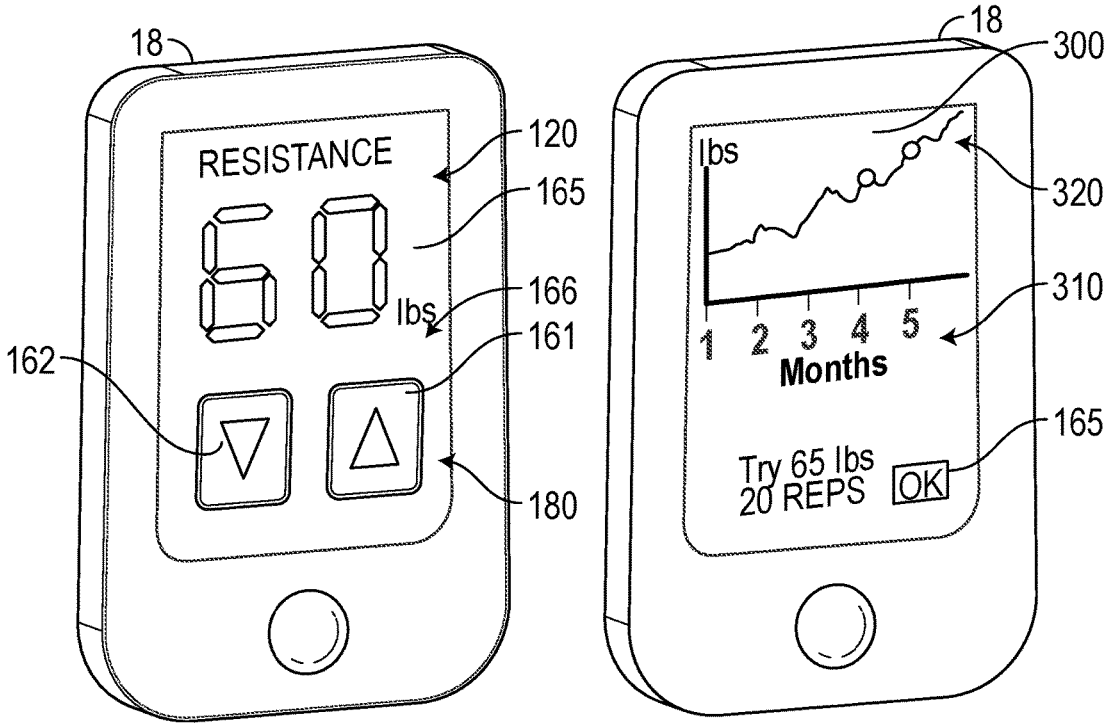
FIG. 5B is a front view of a second smartphone interface showing the person's exercise history and goal information.

The user interface 150 of the controller circuit 130 preferably includes at least a switch 161 for increasing cable unwind resistance 120 and a switch 162 for decreasing cable unwind resistance 120 (FIGS. 2 and 5A). Such switches 161,162 may be soft switches 166 displayed on a touchscreen by a software application 180 running on the controller circuit 130, at least one wireless remote 200, a smart phone 18, or the like. In some embodiments the controller circuit 130 includes a wireless transceiver 190 to communicate with the at least one wireless remote 200 or the smart phone 18 through the use of commonly-used wireless protocols such as BLUETOOTH®, WIFI®, or the like (FIGS. 5A, 5B).

Preferably such a wireless remote 200 is fixed proximate the distal end 78 of the at least one cable 70, such that the person 20 has ready access to the switches 161,162. For example, the at least one wireless remote 200 may be incorporated into the handles 174 (FIG. 2) so that while the person 20 is exercising he may increase or decrease the cable unwind resistance 120 without ceasing to exercise.

In some embodiments the motor 80 is a stepper motor, and the controller circuit 130 includes the wireless transceiver 190 and is configured for reporting to the software application 180 on the smartphone 18 a current position value of the stepper motor 80. As such, the software application 180 is configured to convert the current position value of the stepper motor 80 into a cable unwind resistance 120 value or setting for tracking the person's exercise progress 300 over time and for suggesting cable unwind resistance settings 310 over time to achieve a preset exercise goal 320 of the person 20 (FIGS. 5A & 5B). Such an unwind resistance setting 310 may be converted into an estimated weight in pounds equivalent measurement by the software application 180. In such an embodiment, an environment full of different exercise machines 15 may each include one of the exercise devices 10 with a different ID number, the software application 180 configured for reading the plurality of the exercise devices 10 on various exercise machines 15 to track the person's exercising history and goals on each exercise machine 15 separately.

While a particular form of the invention has been illustrated and described, it will be apparent that various modifications can be made without departing from the spirit and scope of the invention. For example, the shape of the enclosure as shown in the drawings may be varied considerably and still meet the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms.

Accordingly, the inventor reserves the right to add additional claims after filing the application to pursue such additional claim forms for other aspects of the invention.

What is claimed is:

1. A portable exercise device comprising: a. a rigid enclosure having an outer wall that defines an internal space therein, the rigid enclosure includes a cable aperture; b. a winding assembly rotationally captured within said internal space within said outer wall of said rigid enclosure, the winding assembly includes a first circular flange with a first rotational bearing, a second circular flange with a second rotational bearing, a winding spool for receiving a proximal end of a cable wound around the winding spool in a first rotational direction, the cable being affixed to a grip element at a distal end of the cable which extends out of said cable aperture, the cable unwinds in a second rotational direction opposite the first rotational direction when the distal end of the cable is pulled away from the winding spool; c. a stepper motor having a rotational shaft to which a rotor plate is fixed, a torsion spring connected to the rotational shaft between the rotor plate and the winding spool, a first end of the torsion spring being fixedly connected to the rotor plate and a second end of the torsion spring, opposite the first end of the torsion spring, being fixedly connected to the winding spool, whereby rotation of the stepper motor rotates the rotor plate and causes the torsion spring to respectively increase or decrease a cable unwind resistance that respectively inhibits or assists the unwinding of the cable from the winding spool, wherein the stepper motor, the rotational shaft, the rotor plate, the torsion spring, and the winding spool are contained within said internal space of said rigid enclosure; and d. incremental resistance switches displayed on a touch-screen by a software application running on a controller circuit which includes a resistance selection interface; e. wherein a preset load rating may be selected on the touch-screen to facilitate incremental changes to the cable unwind resistance through said software application.

2. The exercise device in accordance with claim 1, further comprising:

an attachment mechanism including at least one magnet fixed with said rigid enclosure and configured for magnetically attaching said portable exercise device to a magnetically attractive surface.

3. The exercise device in accordance with claim 1, further comprising:

an attachment mechanism including a mechanical clamp that is fitted into a dovetail slot.

4. The exercise device in accordance with claim 1, further comprising:

said torsion spring is configured to cause the cable to be re-wound around said winding spool.

* * * * *